US005749791A

United States Patent [19]

Passeri, Jr.

[11] Patent Number: 5,749,791

[45] Date of Patent: May 12, 1998

[54] GOLF BALL PUTTER

[76] Inventor: Robert V. Passeri, Jr., 6925 W. Hobart Ave., Chicago, Ill. 60631

[21] Appl. No.: 716,554

[22] Filed: Sep. 18, 1996

[51] Int. Cl.[6] ..... A63B 53/04

[52] U.S. Cl. ..... 473/251; 473/340; 473/350

[58] Field of Search ..... 473/251, 350, 473/286, 340, 345, 349, 329, 324, 256, 313; D21/217, 218, 219

[56] References Cited

U.S. PATENT DOCUMENTS

| | | | |
|---|---|---|---|
| D. 234,962 | 4/1975 | Swash | 473/340 |
| D. 334,039 | 3/1993 | Tanaka | D21/219 |
| D. 340,962 | 11/1993 | Phillips | D21/219 |
| 3,632,112 | 1/1972 | Jacobs | 473/286 |
| 4,248,430 | 2/1981 | Kepler | 473/286 |
| 4,580,784 | 4/1986 | Brill | 473/286 |
| 4,815,739 | 3/1989 | Donica | 473/313 |
| 4,976,436 | 12/1990 | Serizawa | 473/286 |
| 5,127,653 | 7/1992 | Nelson | 473/251 |
| 5,456,464 | 10/1995 | Davenport | 473/350 |

*Primary Examiner*—Sebastiano Passaniti
*Attorney, Agent, or Firm*—Wallenstein & Wagner, Ltd.

[57] ABSTRACT

An improved golf ball putter is disclosed. The golf ball putter comprises an elongated head having a face including a sweet spot for striking a golf ball. The putter further includes a shaft having a proximal end connected to the head and a distal end extending away from the head. The head includes a generally arcuate aperture in spaced relationship from the face and centered about the sweet spot. The aperture extends vertically through the head and has a diameter parallel to the face substantially equal in length to the diameter of the golf ball.

8 Claims, 1 Drawing Sheet

GOLF BALL PUTTER

DESCRIPTION

1. Technical Field

The present invention relates to an improved head design for a golf putter.

2. Background Prior Art

Golf ball putters typically include a head having a face for striking a golf ball. The face usually has an area referred to as a "sweet spot" where one preferably strikes the ball in order to obtain the most desirable result. Various designs have been proposed to assist a golfer in aligning the sweet spot with the golf ball while swinging the club. However, such designs have proven less than satisfactory.

The present invention is provided to solve this and other problems.

SUMMARY OF THE INVENTION

It is an object of the invention to provide an improved golf ball putter.

In accordance with the invention, the golf ball putter comprises an elongated head having a face for striking a golf ball. The face includes a sweet spot. The putter further comprises a shaft having a proximal end connected to the head and a distal end extending away from the head. The head includes a generally arcuate aperture in spaced relationship from the face and centered about the sweet spot. The aperture extends vertically through the head and has a diameter parallel to the face. The diameter of the aperture is substantially equal in length to the diameter of the golf ball.

It is contemplated that the aperture is semicircular in cross section. Alternatively, the aperture may be triangular, or the like.

Other features and advantages of the invention will be apparent from the following specification taken in conjunction with the following drawing.

DETAILED DESCRIPTION

Figure 1:
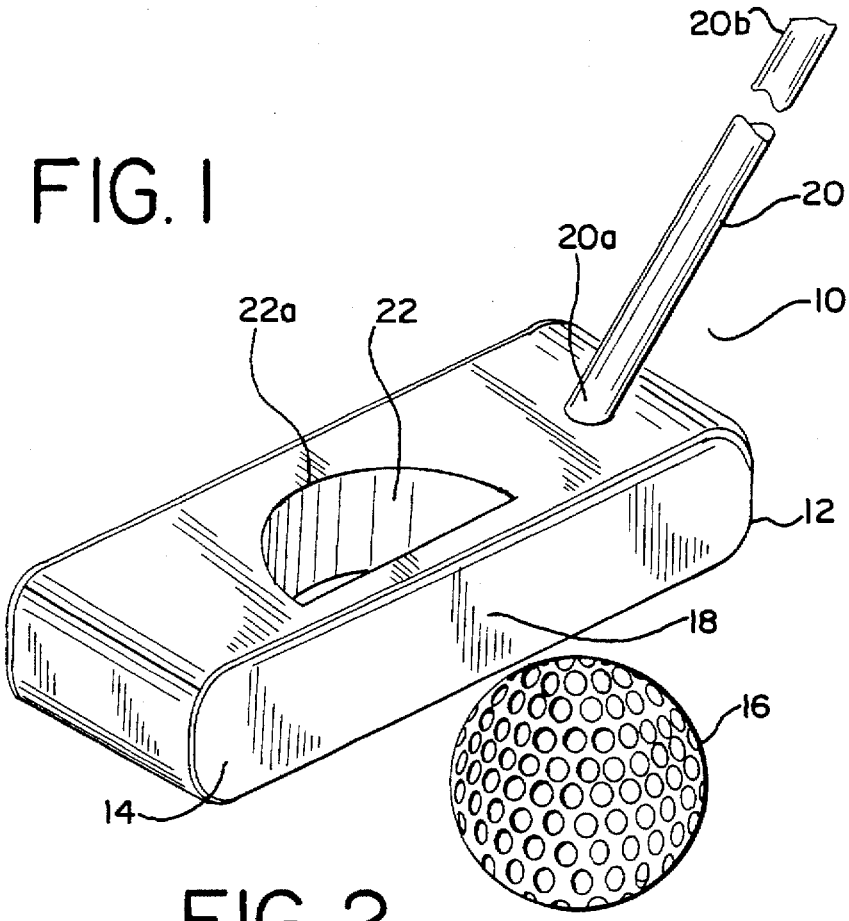
FIG. 1 is a perspective view of the golf ball putter of the present invention.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

An improved golf ball putter, generally designated 10, is illustrated in FIGS. 1–4.

The golf ball putter 10 comprises an elongated head 12, 4.5" in length, 1.5" in width, and 1.0" high. The head 12 has a face 14 for striking a golf ball 16. The face 14 includes an area generally referred to as a sweet spot 18. The putter 10 further comprises a shaft 20 having a proximal end 20*a* connected to the head 12 and a distal end 20*b* extending away from the head 12. The head 12 includes a generally arcuate, semicircular aperture 22 in spaced relationship from the face 14 and centered about the sweet spot 18. In fact, the semicircular aperture 22 has an apex 22*a* which is aligned with the sweet spot 18. The aperture 22 extends vertically through the head 12 and has a diameter "d" parallel to the face. The diameter "d" is approximately equal in length to the diameter of the golf ball 16.

Figure 2:
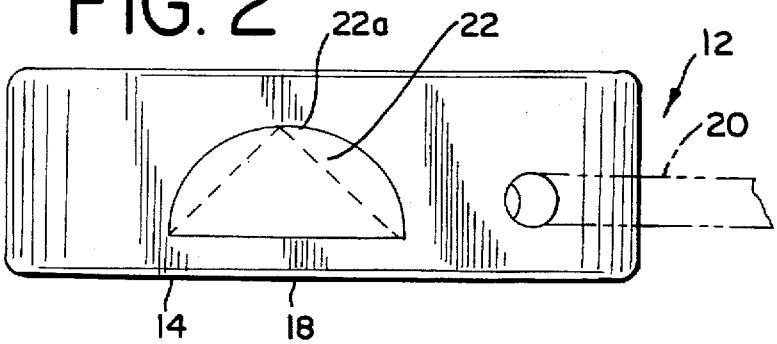
FIG. 2 is a top view of the golf ball putter of FIG. 1.
Figure 3:
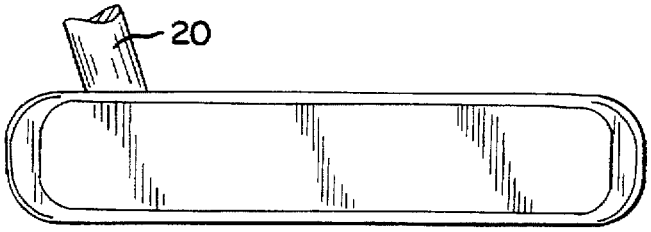
FIG. 3 is a rear view of the golf ball putter of FIG. 1.
Figure 4:
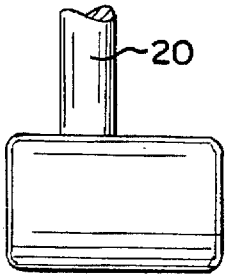
FIG. 4 is an end view of the golf ball putter of FIG. 1.

While it is contemplated that the aperture 22 is semicircular in cross section, it could alternatively be another shape, such as triangular (as illustrated in phantom in FIG. 2).

The head 12 is preferably made of stainless steel or aluminum. In practice, a golfer, looking down on the golf ball 16 and the head 12, aligns the golf ball 16 with the semicircular aperture 22, which automatically aligns the golf ball 16 with the sweet spot 18. This alignment has been found to be quite easy, as the golfer simply has to align the round shape of the golf ball 16 with the corresponding shape of the aperture 22.

The aperture 22 has the further benefit of increasing the size of the sweet spot 18 by increasing the head-to-toe weight distribution of the head 12.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. For a golf ball putter comprising an elongated head having a face for striking a golf ball, said face including a sweet spot, the putter further comprising a shaft having a proximal end connected to said head and a distal end extending away from said head, an improvement to the head for better alignment of the golf ball with the sweet spot, the improvement comprising a generally arcuate aperture in spaced relationship from said face and centered about said sweet spot, said aperture extending vertically through said head and having a diameter and an apex, said diameter being parallel to and proximate to said face and having a length substantially equal to the diameter of a golf ball, said apex oriented such that said apex is aligned with said sweet spot.

2. The improvement of claim 1 wherein said aperture is semicircular.

3. The improvement of claim 1 wherein said aperture is triangular.

4. The improvement of claim 1 wherein said aperture is a regular polygon.

5. A golf ball putter comprising:

an elongated head having a face for striking a golf ball, said face including a sweet spot; and a shaft having a proximal end connected to said head and a distal end extending away from said head, wherein said head includes a generally arcuate aperture in spaced relationship from said face and centered about said sweet spot, said aperture having a chord and an apex, said aperture extending vertically through said head, said chord being parallel to and proximate said face and having a length substantially equal to the diameter of a golf ball, said apex being aligned with said sweet spot.

6. The improvement of claim 5 wherein said aperture is semicircular.

7. The improvement of claim 5 wherein said aperture is triangular.

8. The improvement of claim 5 wherein said aperture is a regular polygon.

* * * * *